United States Patent [19]

Klygis

[11] 4,330,058

[45] May 18, 1982

[54] CONTAINER CARRIER PREFORM STRIP

[75] Inventor: Mindaugas J. Klygis, Barrington, Ill.

[73] Assignee: Illinois Tool Works Inc., Chicago, Ill.

[21] Appl. No.: 159,028

[22] Filed: Jun. 13, 1980

[51] Int. Cl.[3] ..... B65D 71/00; B65D 75/00; B65D 85/62

[52] U.S. Cl. ..... 206/150; 206/158; 206/161; 294/87.2

[58] Field of Search ..... 206/151, 158, 150, 161, 206/199, 805, 427; 294/87.2

[56] References Cited

U.S. PATENT DOCUMENTS

| | | | |
|---|---|---|---|
| 3,038,602 | 6/1962 | Rapata | 206/150 |
| 3,044,230 | 7/1962 | Fisher | 53/35 |
| 3,084,792 | 4/1963 | Poupitch | 206/150 |
| 3,232,422 | 2/1966 | Whyte | 206/150 |
| 3,874,502 | 4/1975 | Weaver | 206/150 |
| 4,018,331 | 4/1977 | Klygis | 206/199 |
| 4,149,631 | 4/1979 | Cunningham | 206/150 |

*Primary Examiner*—William T. Dixson, Jr.
*Attorney, Agent, or Firm*—Thomas W. Buckman

[57] ABSTRACT

A strip of relatively thin thermoplastic material particularly designed to be longitudinally permanently stretched so as to be transformed from a preform having a plurality of relatively small apertures into a container multi-packaging device having a similar plurality of larger can receiving apertures. The apertures in the preform are formed by bands which are designed to be reconfigured by stretching by the design of segments of the strip which are configured to have a non-uniform width with a narrow region intermediate the extremities of such a segment to effectively control the stretching of such a segment when subjected to stretching forces sufficient to elongate the segment beyond its elastic limit.

5 Claims, 3 Drawing Figures

CONTAINER CARRIER PREFORM STRIP

BACKGROUND AND SUMMARY OF THE INVENTION

This invention relates to thin film plastic multiple container carrier handling device. The invention more particularly relates to a strip of thin plastic material which is designed to be selectively transformed into such plastic multi-packaging devices capable of effective association with a plurality of can-type carriers.

Container carriers of the type described are widely used in a variety of forms, including devices such as shown in U.S. Pat. No. 2,874,835 and more recently devices shown in U.S. Pat. No. 4,018,331. Efforts have been made to reduce the amount of plastic material utilized in such carrier devices and such examples are shown in scrapless carrier configurations in U.S. Pat. Nos. 3,084,792 and 3,044,230. Such a scrapless carrier is generally provided with a plurality of slits longitudinally of the strip which are designed so that the interior can be transversely stretched or reconfigured during the application to can-type containers.

The subject invention represents a unique advance in the art because of the design of a strip which includes band segments particularly designed to be highly stretched longitudinally in a controlled manner.

It is accordingly a primary object of the invention to provide a preform device which can be transformed permanently into a package making strip having apertures which are designed to be associated with containers such as can-type devices.

A further principle object of the invention is to provide a carrier preform which minimizes the material used while maximizing the strength of the carrier and the integrity of the package created thereby.

An advantage of the invention is the ability to produce a can carrier device by highly stretching a preform and reducing the potential of failure of the material when it is stretched from a preform position to a permanently reconfigured carrier strip.

The above objects and advantages are obtained by the preform of the invention which basically includes a strip of plastic material provided with a plurality of relatively small apertures defined by generally continuous bands. The apertures are typically arranged in pairs on either side of the center line and preferably elongated in the direction transverse the center line. The strip is particularly designed to be highly stretched in the direction of the longitudinal center line by providing band segments located and extending in the direction of stretch which include prethinned or prenarrowed regions intermediate their extremities so that upon the application of a high stretching force the band segments reliably stretch and orient without failure or rupture of the bands.

Other objects and features of the invention will be readily apparent upon perusal of the hereinafter following specification and drawings.

DETAILED DESCRIPTION OF THE PREFERRED EMBODIMENT

Figure 1:
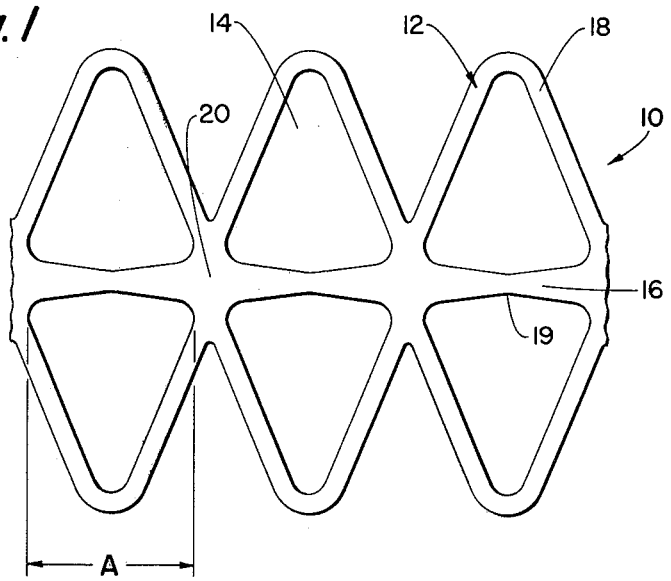
FIG. 1 is a top plan view of a segment of a preform strip which incorporates the invention.

Referring first to FIG. 1, a representative embodiment of a preform device made in accordance with the invention is shown. The preform 10 shown in FIG. 1 will be discussed simultaneously with the carrier device 110 shown in FIG. 2 and which is created by highly longitudinally stretching the preform 10 along the longitudinal center line thereof. It should, therefore, be noted that elements in carrier device 110 are similar to elements in the preform 10 with the addition of a prefix "1".

The preform 10 will basically include a series of bands 12 which create apertures 14 in the strip. The apertures 14 are preferably elongated in a direction extending at right angles to the center line and in this embodiment are shown to be generally triangular. Again, in the embodiment shown, in keeping with the teachings of the prior art, an array of bands is created which includes a pair of rows of laterally opposing bands 12 integrally connected by webs 10. The bands 12 are shown to include an inner band section 16 and an outer band section 18.

Particular attention is directed to the configuration of the inner band section 16. Thusly, it should be noted that a series of bands 16 are essentially common bands for the laterally opposed band sections 12. More particularly, it should be noted that a narrowed region 19 exists intermediate and preferably midway the extremities of such a band 16. The pairs of bands 12 are integrally linked together by a series of web means 20, again keeping with the prior art.

Figure 2:
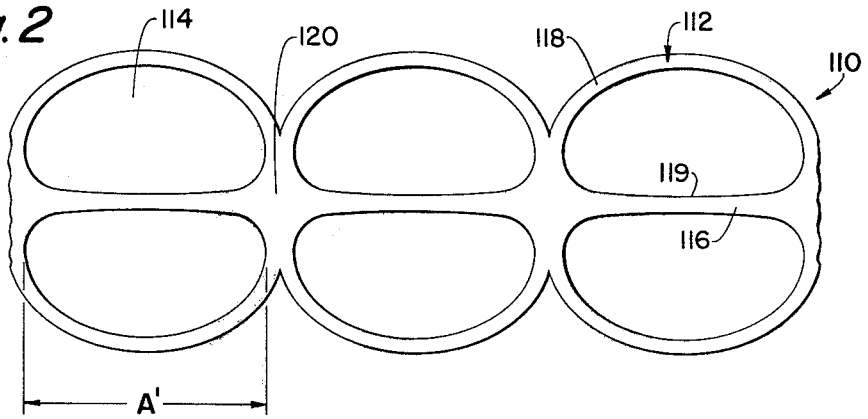
FIG. 2 is a top plan view of the preform strip shown in FIG. 1 which has been stretched longitudinally to create a carrier device.

As an example of the carrier device created by the preform of FIG. 1, attention now is directed to FIG. 2. Upon application of a high stretching force longitudinally of the preform 10 and along the center line of the strip, a carrier device 110 is created which includes pairs of laterally adjacent bands 112 integrally connected by webs 120. Due to the prethinning regions 19, the inner band regions 119 of the carrier device 110 are reliably thinned and oriented beyond their elastic limits. Without such a prethinning region, the area of orientation would not be so reliably formed and conceivably would result in localized necking and rupturing of the band segments where the force is applied. Band segments 119 thus are highly strengthened and oriented while the outer band segments 118 tend to flow freely into a resulting predesigned form. In the case of the carrier device shown in FIG. 2, a band 112 creates an aperture 114 which is substantially D-shaped. It should be understood, however, that applicating equipment that is designed to reconfigure such a carrier device does not require the resulting aperture to be circular. The unstretched band regions 118 thus are free to exert a resilient force on the cans placed in apertures 114 creating a highly efficient package while the center band 119 is strong and reliably formed without a localized necking region.

Figure 3:
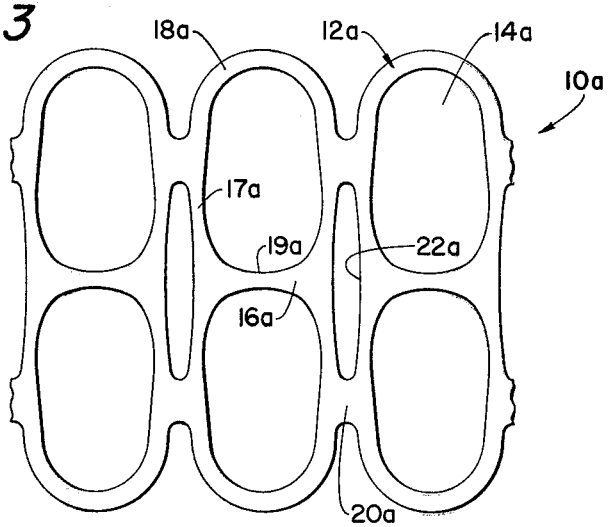
FIG. 3 is an alternate embodiment of a preform strip incorporating the invention.

While one embodiment of the invention is shown in FIGS. 1 and 2, it should be apparent that the basic teachings of the invention can be incorporated in a number of embodiments of preform strips. For example, FIG. 3 shows a preform strip **10*a* incorporating many of the same features of preform strip 10 in FIG. 1. It will include a pair of rows of bands 12*a*** creating apertures

14*a*. The bands 12*a* are arranged in pairs of laterally opposed bands much in keeping with the prior art practice. However, at this point, it should be clearly understood that the invention is not limited to preform strips or carrier devices of a two-lane variety but may be multi-lane as long as the prethinning of band segments are utilized.

In the embodiment of FIG. 3, for example, the interconnecting webs 20*a* are configured as a pair of such webs spaced on either side of the longitudinal center line which enable a finger hole creating aperture 22*a* to be utilized. The preform 10*a* is thus designed to be highly stretched along the longitudinal direction along the line which the inner band sections 16*a* are located, since the inner band sections 19*a* are thinned in the region intermediate the extremities a carefully controlled band segment for a carrier device is obtained. However, it should be also noted that other regions of the band may be similarly designed for ultimately being stretched beyond their elastic limits or to any limit. Therefore, region 17*a* which interconnects with the juncture of the extremities of the inner band sections 16*a* and the outer band sections 18*a* are also thinned so that they may be stretched lightly without fear of rupturing or localized necking.

It should also be understood that a single common band designed for stretching need not be essentially a pair of spaced bands located on either side of a center line may be utilized as long as they incorporate the prethinned regions intermediate the extremities.

Thus it is apparent that there has been provided, in accordance with the invention, a container carrier preform strip that fully satisfies the objects, aims and advantages set forth above in that a particular segment of a preform strip is designed to accommodate and accept a high stretch resulting in an oriented band segment that is uniformly stretched without localized rupture or stretching.

The invention is thus described in conjunction with specific embodiments and it is evident that many alternatives and modifications and variations may be apparent to those skilled in the art in light of the foregoing description. Accordingly, it is intended to embrace all such alternatives, modifications and variations that fall within the spirit and scope of the appended claims.

I claim:

1. A container carrier preform strip of substantially uniform thickness adapted to be stretchingly, permanently deformed to create a package making device for a plurality of substantially identical containers, said package making device defined by a plurality of apertures of predetermined circumference for receiving and retaining containers, the preform strip including a plurality of bands creating a plurality of apertures arranged in an array of a plurality of rows and a plurality of ranks, each aperture in the array having substantially smaller circumferences than said predetermined circumference in the resulting package making device, the apertures in the preform being elongated in directions perpendicular to the length axis of the strip, each band in said preform including first regions extending in the direction of said length axis and designed to be highly stretched and oriented and second regions associated with said first regions defining the remaining portions of the bands, the first band regions including a narrowed section intermediate its extremities serving to locate the point of limitation of elongation and orientation of said first regions upon the application of forces in the length direction of said regions.

2. The container carrier preform strip of claim 1 wherein the first regions are located on a central longitudinal axis, and from a common band segment for a pair of laterally opposing bands extending on either side of said longitudinal axis.

3. The preform strip of claim 1 wherein the narrowed section of each first band region is midway the extremities thereof, the remaining sections tapering in width to a maximum width at each extremity of said region.

4. A container carrier preform strip of substantially uniform thickness adapted to be stretched longitudinally and permanently deformed to create a package making device including a plurality of pairs of bands oppositely positioned along a common band segment separating said pairs of bands, said common band separating each pair of apertures thinned intermediate its extremities to promote longitudinal stretching of each segment of said common band, said thinned portion of each segment of said common band having a transverse dimension not greater than the transverse dimensions of the remaining portions of each of said pairs of bands with which it is associated.

5. A package making device made in accordance with claim 4 wherein the apertures of said device are elongated in the longitudinal direction.

* * * * *